US007077416B2

(12) United States Patent
Duarte

(10) Patent No.: US 7,077,416 B2
(45) Date of Patent: Jul. 18, 2006

(54) LOCOMOTION DEVICE FOR PHYSICALLY DISABLED PERSONS

(75) Inventor: Claudio Blois Duarte, Brasilia (BR)

(73) Assignee: Associacao Das Pioneires Sociais, Brasilia (BR)

( * ) Notice: Subject to any disclaimer, the term of this patent is extended or adjusted under 35 U.S.C. 154(b) by 197 days.

(21) Appl. No.: 10/495,505

(22) PCT Filed: Nov. 12, 2002

(86) PCT No.: PCT/BR02/00154

§ 371 (c)(1),
(2), (4) Date: Jun. 21, 2004

(87) PCT Pub. No.: WO03/041628

PCT Pub. Date: May 22, 2003

(65) Prior Publication Data

US 2005/0061559 A1 Mar. 24, 2005

(30) Foreign Application Priority Data

Nov. 13, 2001 (BR) ..... 0105828

(51) Int. Cl.
*A61G 5/00* (2006.01)

(52) U.S. Cl. ..... 280/304.1; 297/330; 297/339; 297/DIG. 10; 297/DIG. 4

(58) Field of Classification Search ..... 280/304.1, 280/250.1; 297/330, 339, DIG. 10, DIG. 4
See application file for complete search history.

(56) References Cited

U.S. PATENT DOCUMENTS 3,807,795 A * 4/1974 Weant et al. ..... 297/330
4,119,164 A * 10/1978 Fogg et al. ..... 180/6.5
4,141,094 A * 2/1979 Ferguson et al. ..... 5/85.1
5,556,121 A * 9/1996 Pillot ..... 280/304.1

FOREIGN PATENT DOCUMENTS

| | | | |
|---|---|---|---|
| AU | 588 519 | B1 | 9/1989 |
| FR | 2 492 657 | A1 | 4/1982 |
| WO | WO-93/02911 | A1 | 2/1993 |
| WO | WO-96/29969 | A1 | 10/1996 |
| WO | WO-00/28930 | A2 | 5/2000 |

* cited by examiner

*Primary Examiner*—Christopher P. Ellis
*Assistant Examiner*—Cynthia F. Collado
(74) *Attorney, Agent, or Firm*—Darby & Darby

(57) ABSTRACT

A locomotion device for physically disabled persons, comprising: a chassis (10) mounted onto a pair of rear wheels (11) and a pair of front swiveling wheels (12); a seat frame (20) frontally articulated to the chassis (10), so as to be displaced between a substantially horizontal first position and a second raised position that is markedly downwardly forwardly inclined; a backrest frame (30), which is interiorly articulated to a rear portion of the seat frame (20) and to the chassis (10), in order to be displaced between a first position, which is substantially orthogonal to the seat frame (20), and a second position, which is substantially coplanar to said seat frame (20); an impelling means (40), which is operatively coupled to the chassis (10) and to the seat frame (20), in order to provide the selective displacement of the latter between the first position and the second position; a movement locking means (50), which is mounted to the chassis (10) to allow the selective locking of the rear wheels (11); and a position locking means (60), which is mounted to the chassis (10) and operatively associated to the seat frame (20), in order to maintain the latter in any operational position between the first position and the second position.

16 Claims, 13 Drawing Sheets

LOCOMOTION DEVICE FOR PHYSICALLY DISABLED PERSONS

FIELD OF THE INVENTION

The present invention refers to a device for the locomotion of disabled persons, which allows a disabled person to move both in the sitting position and in the up-right position, as well as to have access to services that are usually inaccessible for a person who remains compulsorily in the sitting position.

BACKGROUND OF THE INVENTION

The utilization of a conventional wheelchair allows the user to have only a relative independence. While the wheelchair promotes mobility, the user still finds difficulty in a number of activities. Such difficulties are usually associated with the user's unalterable position. Remaining in the sitting position, the physically handicapped person founds difficulty in certain everyday activities that are hardly noticed by other persons, such as, for example, to have access and talk to persons in a ticket window, to reach controls that are usually placed at the height of a standing person, such as a button in an elevator, the possibility of working behind counters, benches, or other high surfaces; or working in situations that need direct contact with the public, such as giving classes and conferences, or using the blackboard, etc.

Another problem of the conventional wheelchairs is that they are difficult to handle for transportation, and those that can be disassembled require a difficult and slow operation.

Moreover, for promoting the displacement of the user, the conventional wheelchairs use either electric power, thus requiring an electric motor, or mechanical means, in which case, as a function of being driven by rims provided close to the rear wheels of said wheelchairs, they usually expose the user to the possible contact of his arms with that wheel portion in contact with the ground and which usually brings dirt from the ground.

OBJECT OF THE INVENTION

Thus, it is an object of the present invention to provide a locomotion device for physically disabled persons, which allows the user of said device to stand up and move in this up-right position, in an easy way and without requiring help from other people.

It is a further object of the present invention to provide a device, which besides the aspect above, allows said device to be easily assemble and disassemble by the user himself.

It is a complementary object to provide a device, which, besides the aspects presented above, allows the displacement of said device by the user himself, without submitting him to a possible contact with the device portions that are constantly in contact with the ground.

SUMMARY OF THE INVENTION

These and other objects are achieved by a locomotion device for physically disabled persons, comprising a chassis mounted onto a pair of rear wheels and a pair of front swiveling wheels, said chassis carrying a motor assembly for the selective drive of the rear wheels; a seat frame frontally articulated to the chassis, so as to be displaced between a substantially horizontal first position and a second raised position that is markedly downwardly forwardly inclined; a backrest frame, which is inferiorly articulated to the rear portion of the seat frame and to a movable point of the chassis, in order to be displaced between a first position, which is substantially orthogonal to the seat frame, and a second position, which is substantially coplanar to said seat frame, when the seat frame is displaced between the first position and the second position, respectively; an impelling means, which is operatively coupled to the chassis and to the seat frame, in order to provide the selective displacement of the latter between the first position and the second position; a movement locking means, which is mounted to the chassis to allow the selective locking of the rear wheels; and a position locking means, which is mounted to the chassis and operatively associated with the seat frame, in order to maintain the latter in any operational position between the first position and the second position.

The locomotion device for physically disabled persons of the present invention gives the user some advantages, for example, as to practicability: possibility to reach and access shelves, switches, windows, ticket windows; possibility to work behind counters, benches and other high surfaces; working in situations that require contact with the public, such as giving classes and conferences, or using a blackboard; participating in social events; as to physiological aspects, it improves the functions of the digestive and circulatory systems; it exercises the muscles that are not used in other activities; it strengthens the bones of the legs, by using them in the vertical position; and, as to psychological aspects: it allows the user to reduce his physical restrictions and to maintain a more equalitarian relationship with his peers, inducing the user to have a more positive attitude, which is fundamental to his reintegration to society, increasing his motivation and well-being.

Moreover, the present device allows the user to stand up, to move in both the standing and the sitting positions, to mount and dismount said device by simple operations, with each component part presenting a maximum weight within acceptable limits to be handled by disabled persons, said device further allowing adjustments to fit the user's weight, besides being safe, durable and of a relatively low cost.

BRIEF DESCRIPTION OF THE DRAWINGS

The invention will be described below, with reference to the attached drawings, in which.

DESCRIPTION OF THE ILLUSTRATED EMBODIMENT

Figure 1:
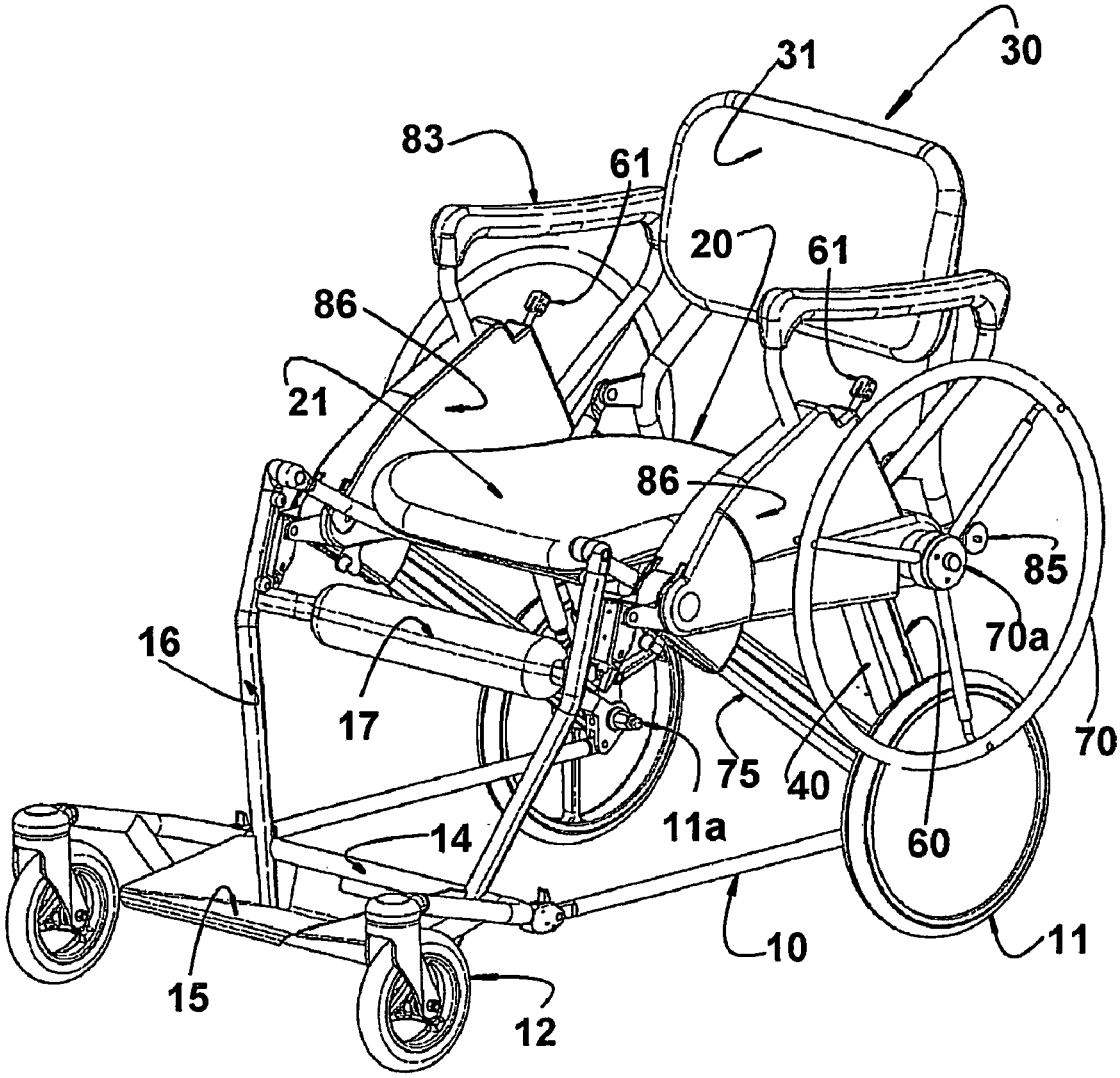
FIG. 1 is a schematic perspective view of the locomotion device of the present invention in the conventional user's sitting position for transportation.
Figure 2:
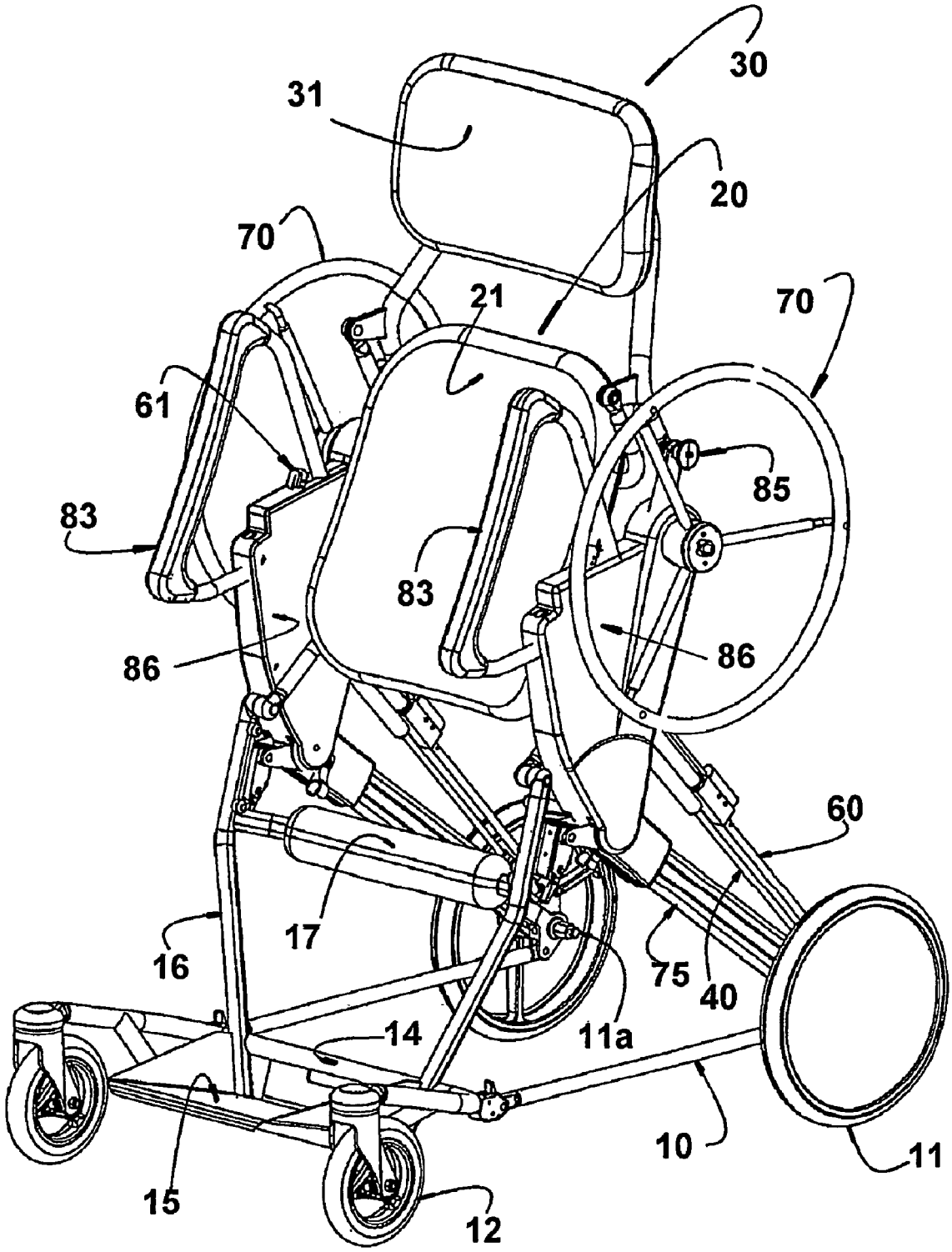
FIG. 2 is a schematic perspective view of the locomotion device of the present invention in the user's standing position.

According to the illustrations, the present invention refers to a locomotion device for physically desabled persons, having a chassis 10 mounted on a pair of rear wheels 11, and a pair of front swiveling wheels 12, said chassis 10 carrying a seat frame 20 and a backrest frame 30, said frames sustaining, respectively, a seat cushion 21 and a backrest cushion 31, for example in a substantially rectangular shape and made of a foamed material placed on a support of plastic material, the respective seat frame 20 and backrest frame 30 being made of a tubular metallic material, for example in light metal alloys, such as titanium or aluminum, in order to allow obtaining a light device with its weight within the acceptable limits to permit disassemble and accommodation of said device, for example in an automobile, by the user himself. However, as a function of determined specific requirements, some parts can be manufactured in stainless steel, bronze or brass, as well as synthetic materials, such as polyurethane, polyamide and fiber-glass reinforced polyesther.

Figure 3:
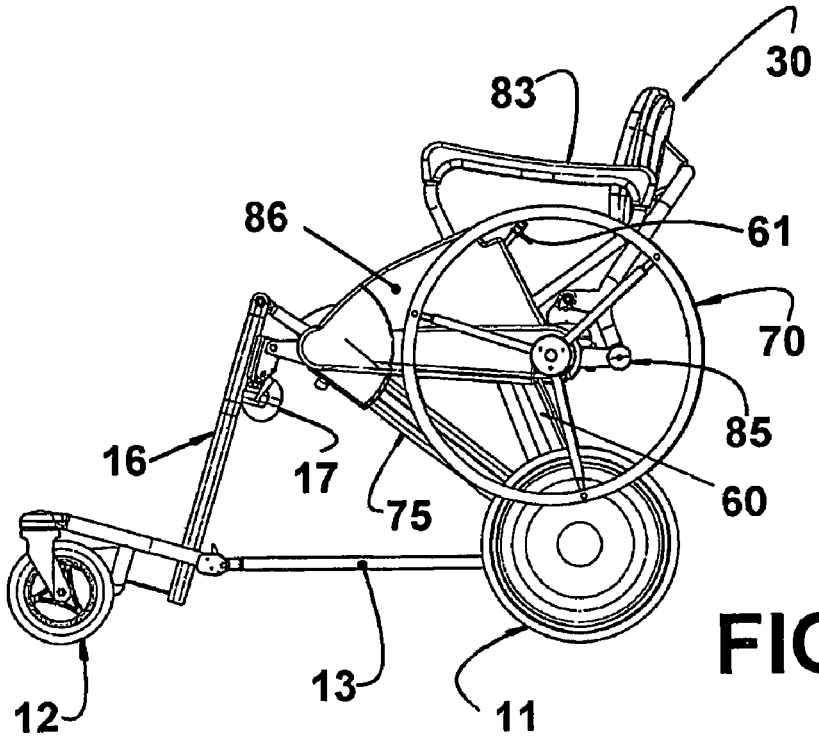
FIG. 3 is a schematic lateral view of the locomotion device of the present invention in the conventional sitting position.
Figure 4:
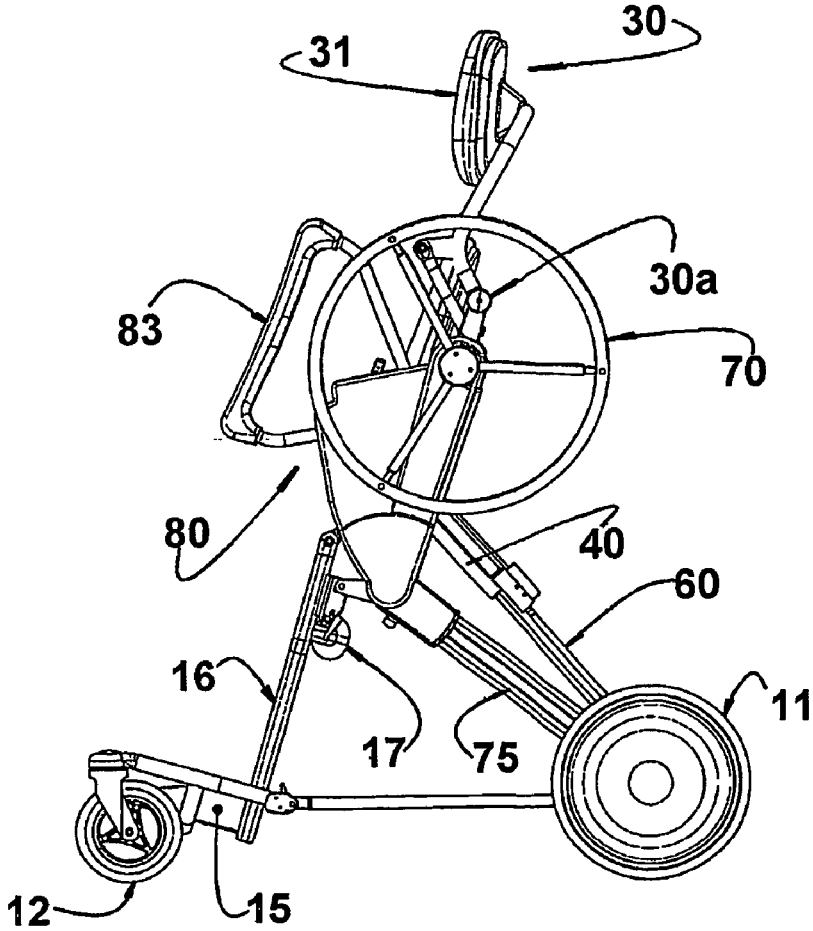
FIG. 4 is a schematic lateral view of the locomotion device of the present invention in the standing position.
Figure 5:
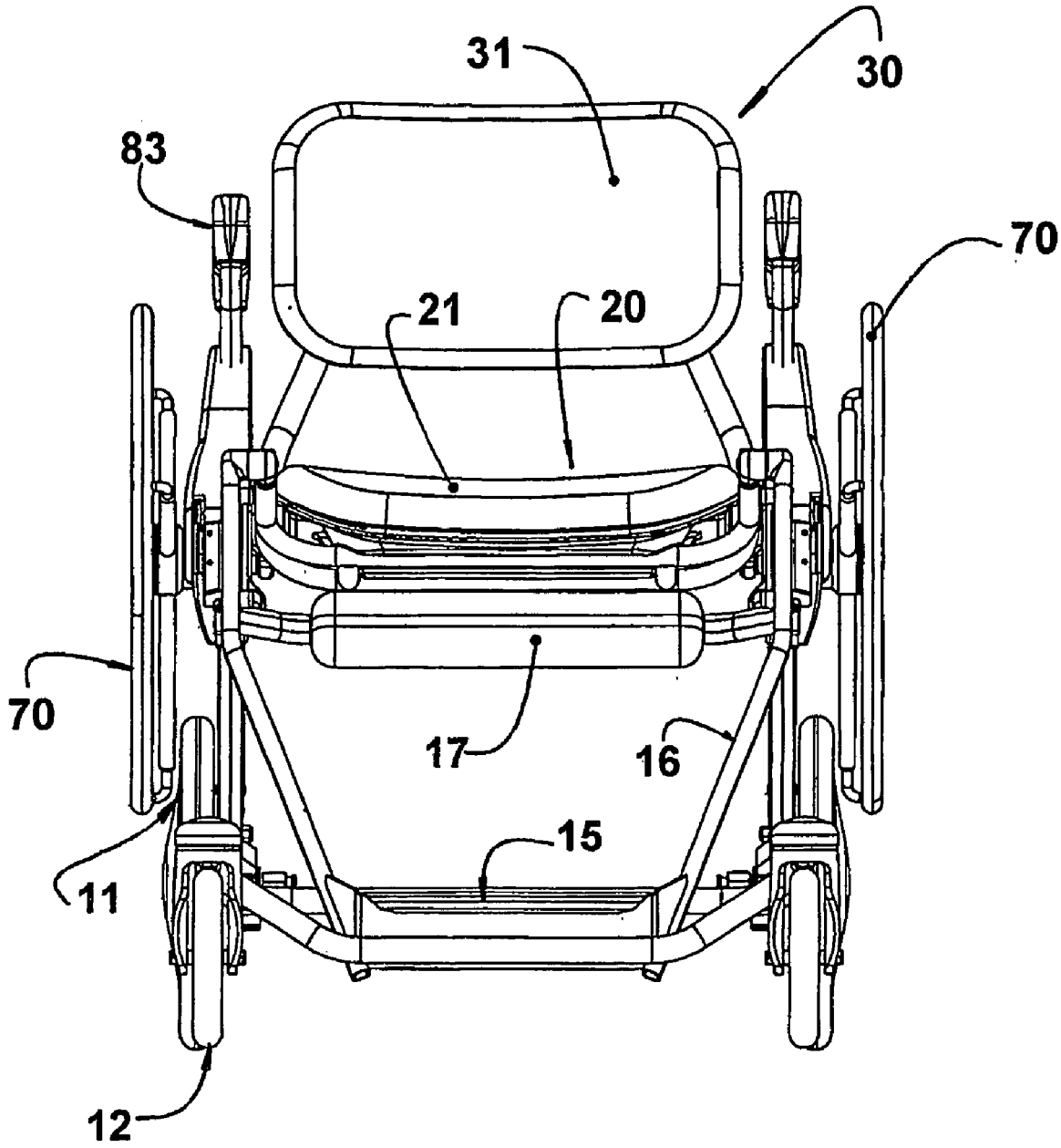
FIG. 5 is a schematic front view of the locomotion device of the present invention in the conventional sitting position.
Figure 6:
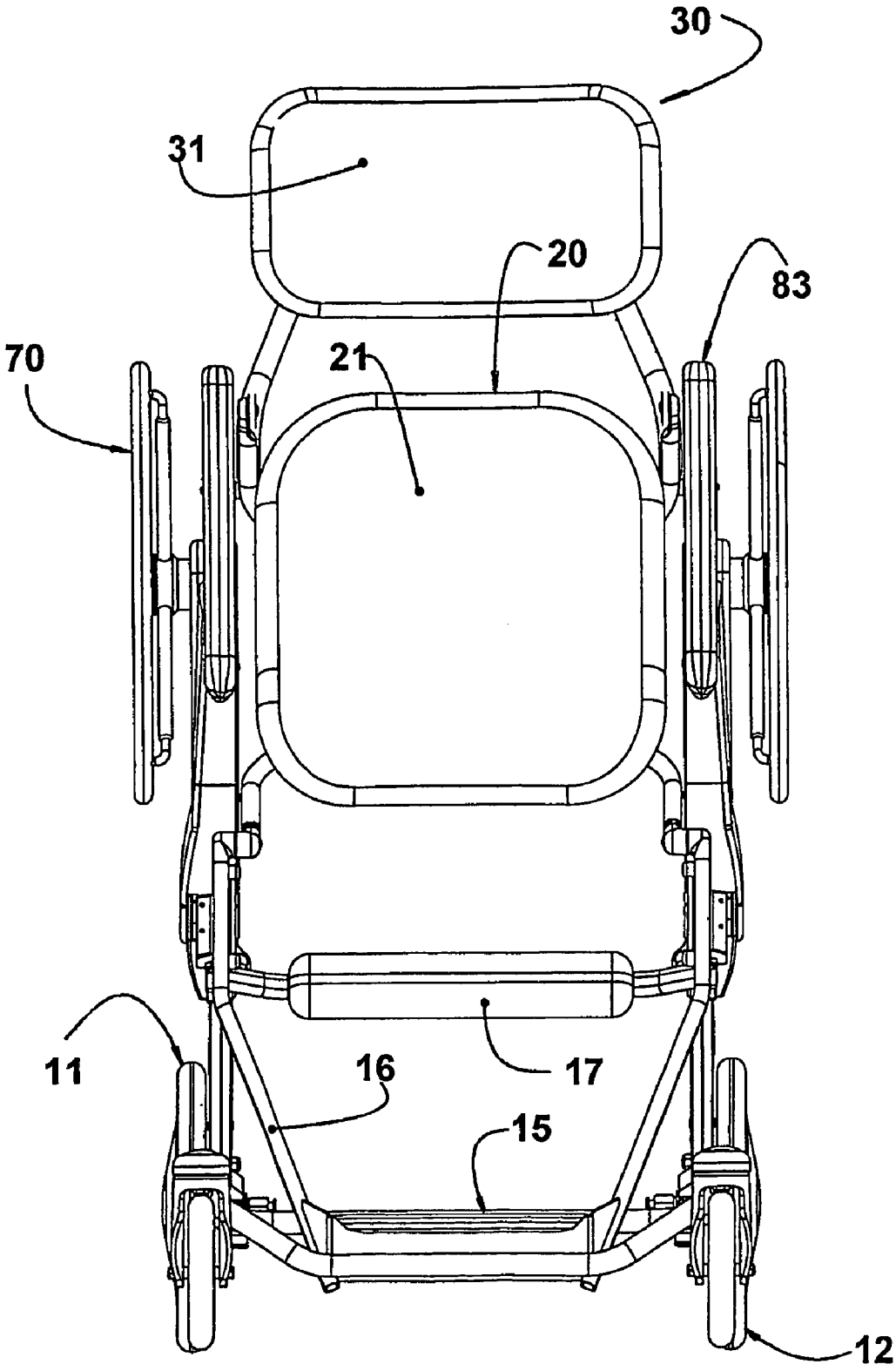
FIG. 6 is a schematic front view of the locomotion device of the present invention in the standing position.

According to the present invention, the seat frame 20 is frontally articulated to the chassis 10, so as to be displaced between a first substantially horizontal position, of conventional use for a sitting user (FIGS. 1, 3, and 5), and a second raised position, which is markedly downwardly frontally inclined, as shown in FIGS. 2, 4, 6, and 9.

In this construction, the rear wheels have a reduced dimension in relation to the conventional rear wheels of such locomotion devices, in order to facilitate the transport of the present device. For promoting an adequate support in the vertical position and stability in case the device stops suddenly, the front wheels 12 are provided at the front region of the chassis 10 forwardly displaced in relation to the seat frame 20.

The backrest frame 30 is articulated, inferiorly, to a rear portion of the seat frame 20 and, operatively, to the chassis 10, in order to be displaced between a first position that is substantially orthogonal to the seat frame 20, and a second position that is substantially coplanar to the seat frame 20 when the latter is displaced between its first position and second position, respectively.

According to the present invention, the present locomotion device for physically disabled persons further comprises an impelling means 40, for example a pneumatic actuator, which is operatively coupled to the chassis 10 and to at least one of said seat frame 20 and backrest frame 30, so as to provide the selective displacement thereof between the first position and the second position of the seat frame 20 and backrest frame 30 of the chassis 10.

In the illustrated solution, the impelling means 40 is operatively coupled to the backrest frame 30, which permits the seat frame 20 to move between its first and second positions, hardly changing the position of the backrest frame 30. This construction further allows the present device to be easily disassembled, as described below.

In the present construction, the impelling means 40 is driven by the user, in order to obtain the second position of the seat frame 20, which position is maintained by actuation of the locks, which are for example manually releasable automatic locks, as described ahead. The displacement of the seat frame 20 between its first and second positions is achieved by an adjustment made to fit to the user's weight.

The device of the present invention allows disassembly thereof in component parts, for example in three component parts for transportation, one of said parts comprising the seat frame 20, the backrest frame 30, and a front portion of the chassis 10 carrying the front wheels 12. The other two dismountable parts of the present device comprise the sides of said device, which are for example equal, each carrying a respective rear wheel 11 and an armrest portion to be described ahead. According to the present invention, the device further comprises a movement locking means 50, which is mounted to the chassis 10 to allow the selective locking of the rear wheels 11, when the user wishes to immobilize the device, for example, to leave the device or to sit therein.

The present locomotion device further comprises a position locking means 60, which is mounted to the chassis 10 and operatively associated with the backrest frame 30, so as to maintain the seat frame 20 in any operative position between its first and second operative positions.

According to a preferred constructive option of the present invention, the motor assembly that allows the displacement of the present device comprises, on each side of the chassis 10, a steering wheel 70, to be manually grasped and having a diameter that is larger than the diameter of the rear wheels 11, each steering wheel 70 having a horizontal shaft 70*a* journalled on a respective side of the seat frame 20 and operatively, coupled to the shaft 11*a* of a respective rear wheel 11 to translate rotation to the latter, in any operational position of the seat frame 20.

In the illustrated construction, the motor assembly includes, on each side of the chassis 10, a first sprocket 71; a second sprocket 72 carried by the chassis 10 in a coaxial position in relation to the articulation shaft of the seat frame 20, said sprockets being coupled to each other through a first chain 75, translating the movement the user is making in the steering wheel 70 to said second sprocket 72, said movement being transferred to each respective rear wheel 11 through a third coaxial sprocket 73 carried by the second sprocket 72 and coupled through a respective chain 75 to a fourth sprocket 74 secured to the shaft of a respective rear wheel 11.

The steering wheel 70 presents a hub 76 around its horizontal shaft 70*a*, to which is coupled the first sprocket 71. The second and third sprockets 72, 73 are mounted around a respective double crown 77 provided around an articulation shaft, which is for example parallel to the rotation shaft of the seat frame 20 in relation to the chassis 10.

In a constructive option illustrated in FIGS. 10–13, each hub 76 carries, in the interior thereof, a respective braking device (not illustrated) of the movement locking means 50, such as a conical shoe, which is actuated through a first lever 51 of said movement locking means 50 and which is provided in the steering wheel 70 externally to the chassis 10 and mounted to its hub 76. Each first lever 51 is actuated by the user and said locking actuation presses a respective brake shoe 52 (FIG. 13) against the braking device, which is positioned so as to avoid rotation of said hub 76.

The device of the present invention comprises, laterally and externally to each adjacent seat frame 20, a respective raising structure 80 (FIGS. 10–13), presenting a rear end 81, articulated to the backrest frame 30, and a front end 82 articulated to the chassis 10, at a region backward of that to which one side of the present device is engaged to the chassis 10 and inferior to the region where the seat frame 20 is articulated to said chassis 10, and the impelling means 40, in the illustrated constructive option, is operatively associated with the backrest frame 30, through at least one raising structure 80. In the illustrated construction, each side of the chassis 10 comprises a respective impelling means 40 associated with the backrest frame 30 through a respective raising structure 80.

Figure 15:
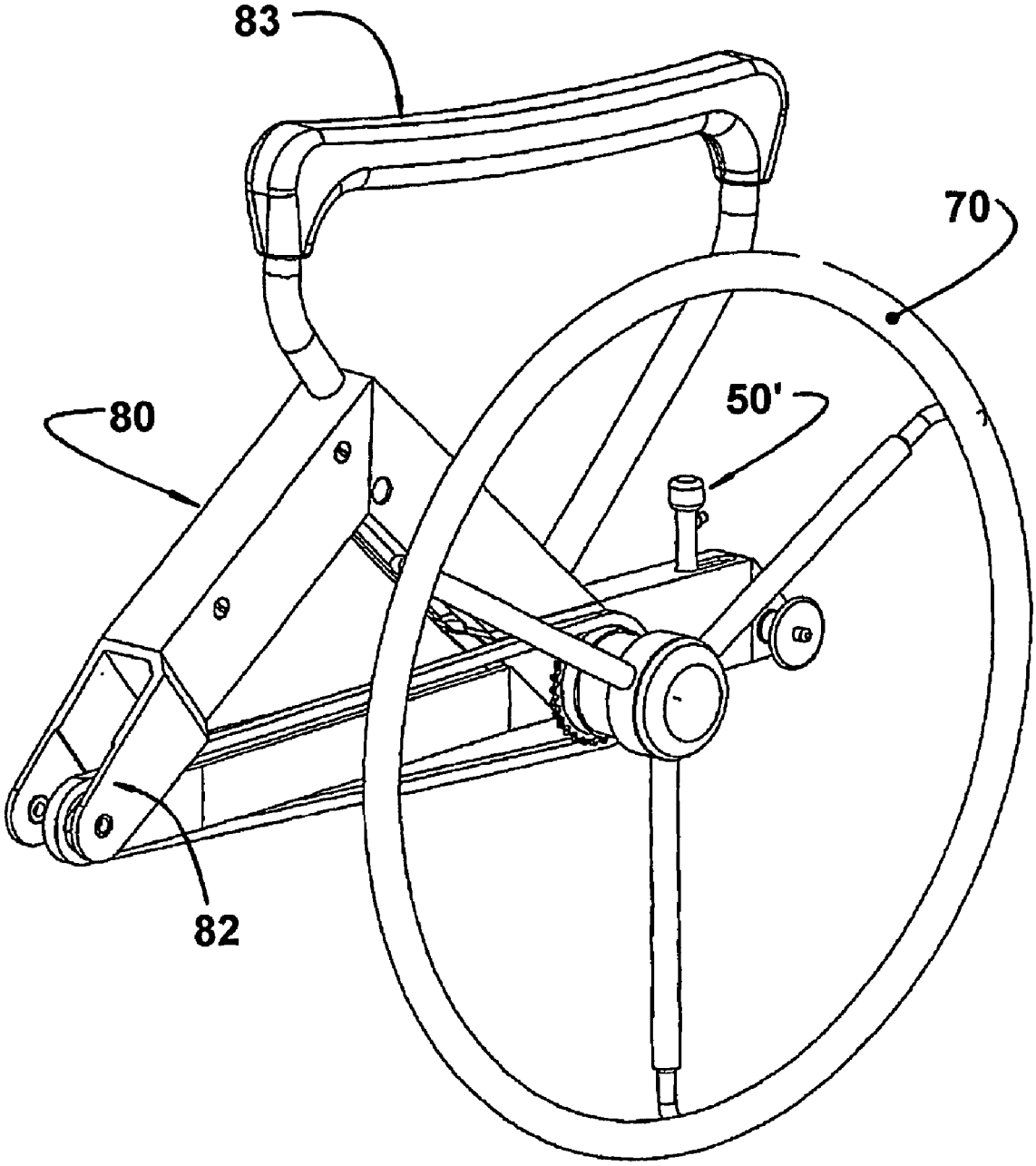
FIG. 15 is a schematic external perspective view of part of one side of the locomotion device of the present invention illustrated in FIG. 10.

FIG. 15 illustrates another construction for the movement locking means, which is indicated in this figure by the reference number 50' said movement locking means 50' being provided on the raising structure 80 adjacent to the rear end 81 of the latter.

In the illustrated constructive option, the locking of the present device in any of the positions of the seat frame 20 is obtained by the user manually moving a pair of second levers 61, each being affixed to a respective raising structure 80, for example, through screws P and non-illustrated keys, in order to actuate in a respective impelling means 40, as described below.

The present solution comprises, for each side of the chassis 10, a rigid rod 10*a* having an upper end mounted to the front end 82 of the raising structure 80, and a lower end mounted to the shaft 11*a* of a respective rear wheel 11.

In the illustrated embodiment, each raising structure 80 carries a respective armrest 83 and bears a respective steering wheel 70 adjacent to the rear end 81 of said raising structure 80.

Figure 14:
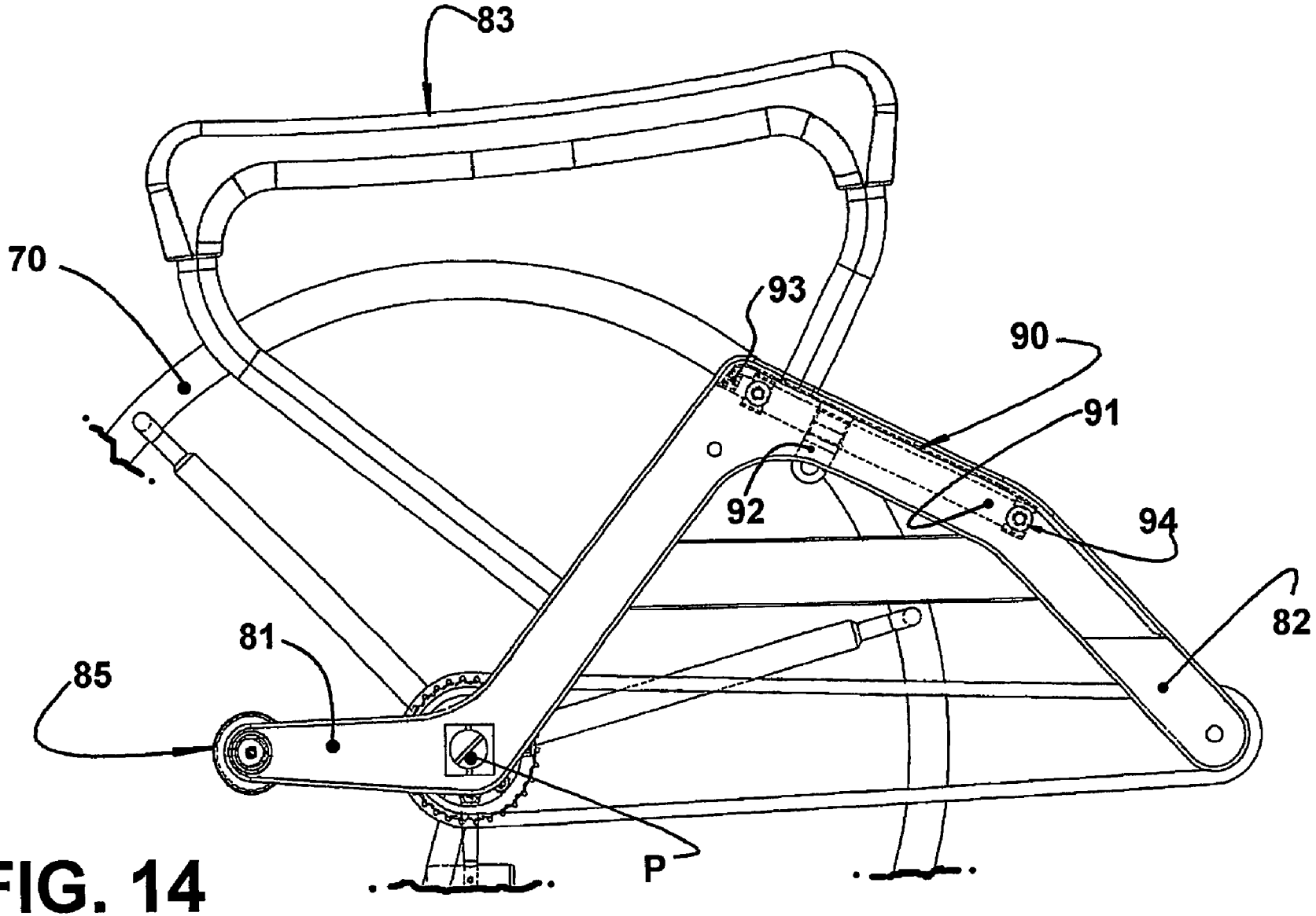
FIG. 14 is a schematic lateral internal view of part of one side of the locomotion device of the present invention.

Each raising structure 80 presents a median portion substantially elevated in relation to its front end 82 and rear end 81 and having the form of an inverted chute, (FIG. 14), where is provided part of the position locking means 60, as described below.

The rear end 81 of each raising structure 80 extends backward of the region of said raising structure 80 bearing a respective steering wheel 70 and it carries a respective engaging element 85 that articulates the backrest frame 30 to the raising structure 80. In the illustrated construction, each engaging element 85 is in the form of a key that is displaced by the user externally to each raising structure 80, between a mounting position and a dismounting position of the present device, which positions represent, respectively, mounting and dismounting conditions of the backrest frame 30.

The front end 82 of each raising structure 80 presents the form of a fork, which is operatively engaged to the chassis 10, in order to allow the raising structure to be articulated around the shaft that carries the double crown 77. Each armrest 83 is mounted to the respective raising structure, adjacent to the median portion of the latter and is provided, superiorly, with a portion coated with an anatomic cushion of foamed material.

In the illustrated construction, each impelling means 40 is operatively associated with the backrest frame 30 through a respective raising structure 80 and it has an upper end 41 mounted under the raising structure 80, at the median portion thereof in the form on an inverted chute, in order to apply in this region a raising force of the seat frame 20 to its second position. Adjacent and parallel to each impelling means 40 is provided a respective mechanical lock 62 of the position locking means 60, such as a telescopic lock construction, each lock being mounted to one side of the chassis 10, having a lower end engaged to the rear end of the chassis 10, and an upper end actuating in the respective raising structure 80 and driven by a respective second lever 61, which is manually operated by the user, so as to obtain a position locking means condition for each of said positions of the seat frame 20. Each illustrated position locking means 60 presents, parallel to each mechanical lock 62, a respective control rod 63 that transmits the movement of the respective second lever 61 to the corresponding mechanical lock 62.

For obtaining each position of the present device, the user moves the second lever 61, in order to unlock the corresponding mechanical lock 62 and allow the pneumatic actuator to raise the seat frame 20 and the backrest frame 30, or to allow the user to exert a force to lead-said frames to the sitting position.

According to the invention, the present device comprises, in each raising structure 80, a respective effort regulating means 90, which is operatively associated with a respective impelling means 40, so as to allow determining the region to which said impelling means 40 will apply force to the respective raising structure 80, as a function of, for example the physical condition of the user to make efforts. Each effort regulating means 90 comprises a threaded rod 91 mounted to the raising structure 80 and carrying a slider 92 to which is articulated the upper end 41 of the impelling means 40. With this construction, a front end 93 of the threaded rod 91 is accessed by the user, who will fit a key (not illustrated), which is adequate to rotatively drive the threaded rod 91 in either direction, to make the slider 92 displace to a position, in order to regulate the force that the impelling means 40 applies to the raising structure 80. The position of the slider 92 determines the lever arm to which is applied the raising force produced by the impelling means 40, allowing to adjust the force required from the user to raise or lower the seat frame 20, which force is determined as a function of the characteristics of the user, for example his weight.

The device of the present invention further comprises belts (not illustrated) for adjustment of the user, which allow him to promote the movement of the seat frame 20 and backrest frame 30 between the sitting position and standing position, with no risk of falling from the present locomotion device. The present solution comprises at least one abdominal belt, securing the user's torso to the backrest frame 30, and at least one sub-patellar belt securing the user's legs, below his knees, to the present device.

To allow the user to displace the seat frame 20 and backrest frame 30 to a substantial up-right position, with the belts being positioned, the user drives the second lever 61, unlocking the telescopic locks 60 in both sides of the present device by making, for example, a forward movement.

Each telescopic lock is mounted to one side of the chassis 10, having a lower end affixed close to the rear wheel 11, and an upper end acting on the raising structure 80.

The internal mechanism of the mechanical locks 62 will simultaneously unlock the seat frame 20 (and backrest frame 30) from its first position and will set up said mechanical locks 62 of the position locking means 60 so as to actuate when the seat frame 20 reaches its second position. This locking is achieved by the user actuating on both armrests 83, pushing them, together with the actuation of the impelling means 40. Inversely, to displace the seat frame 20 from its second position to its first position, the user drives the second levers 61 backwards, unlocking the mechanical locks 62 and setting them up, so that they lock when the present device is with its seat frame 20 in the respective first position, with the user in the sitting position. For achieving this movement of displacing the seat frame 20, the user has to actuate on the armrests 83, pulling them.

The illustrated construction presents a "U" shaped chassis 10, with the lower free ends of its lateral legs 13 bearing, each one, a shaft 11*a* of a respective rear wheel 11, with a front basic leg 14 carrying the pair of front wheels 12 and being dismountably coupled to the lower end 82 of the raising structure 80 and the lateral legs 13 of the chassis 10, the rear end 81 of each raising structure 80 being dismountably coupled to the backrest frame 30 and the seat frame 20, and the backrest frame 30 being collapsible onto a footrest 15 carried by the front basic leg 14 of the chassis 10, when the present device is in a dismounted position.

In the device dismounted position, each lateral leg 13 of the chassis 10 is turned around a shaft that is parallel and adjacent to the shaft 11*a* of the respective rear wheel 11, until being parallel to an adjacent rigid rod 10*a*.

The chassis 10 carries on it front basic leg 14, between the front wheels 12, a footrest 15, for example in the form of a plate of metallic material, which is provided in front of the seat frame 20.

Figure 7:
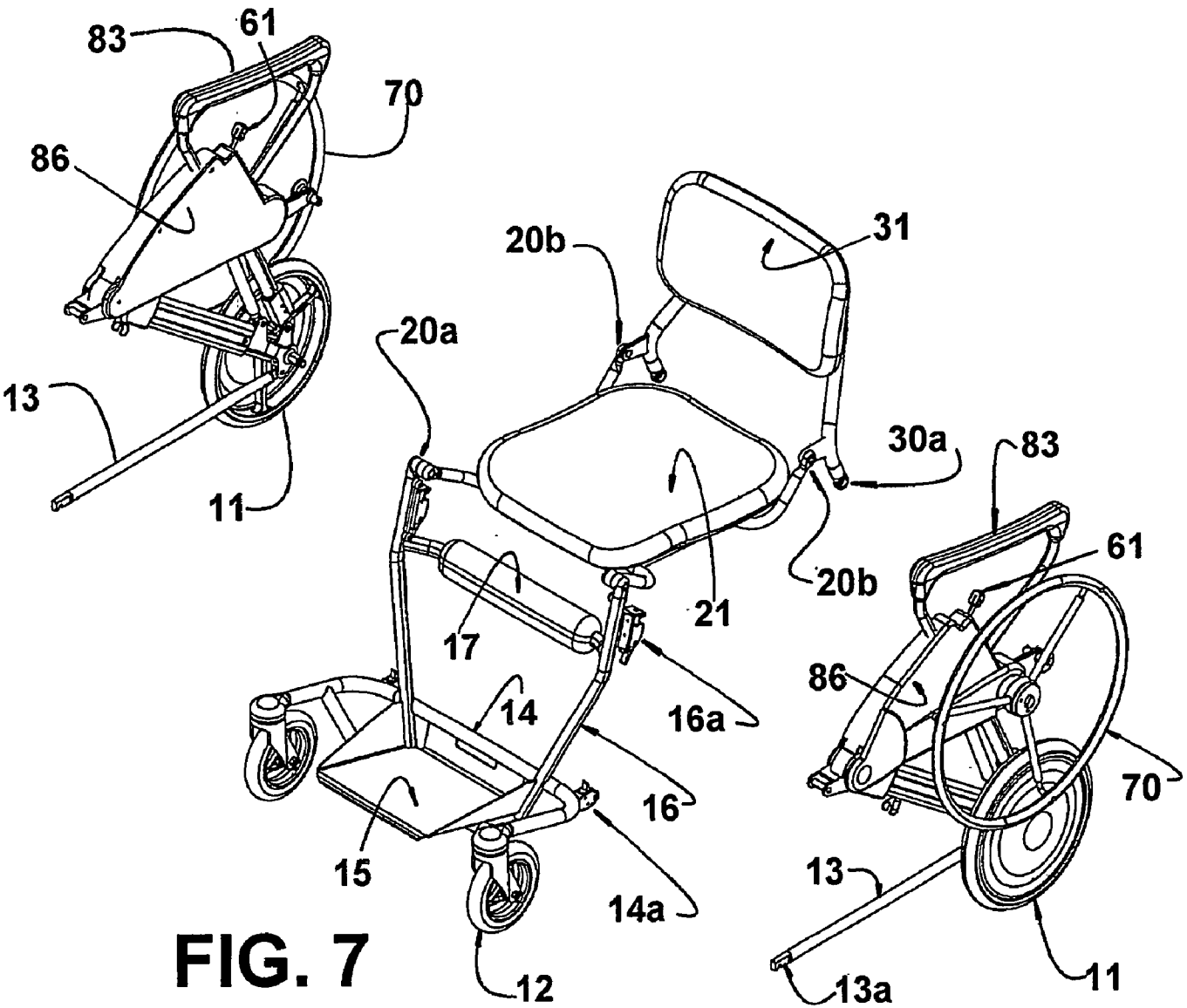
FIG. 7 is a schematic exploded perspective view of the locomotion device of the present invention in the conventional sitting position.
Figure 8:
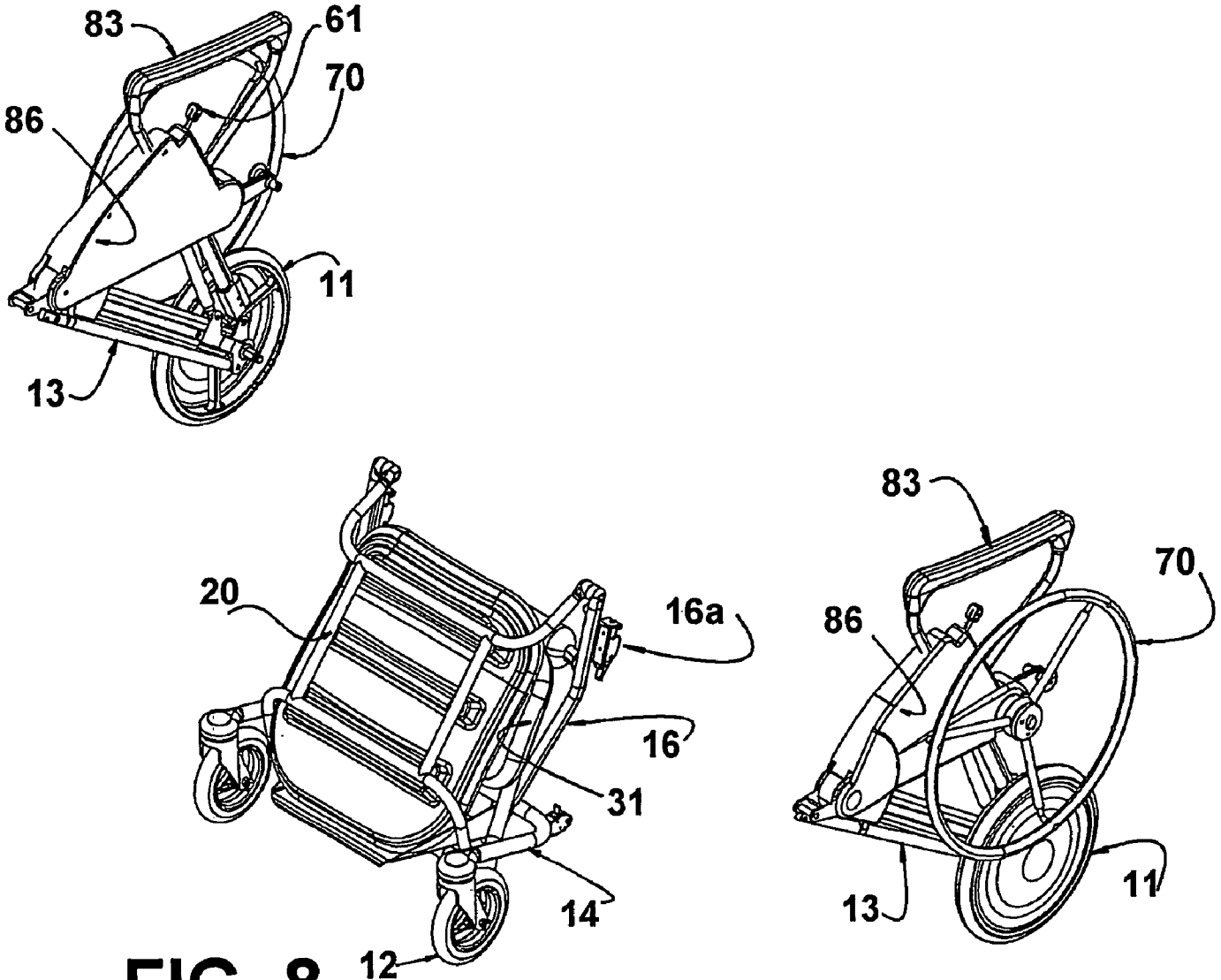
FIG. 8 is a schematic front view of the locomotion device of the present invention in a disassembled position for transportation.
Figure 9:
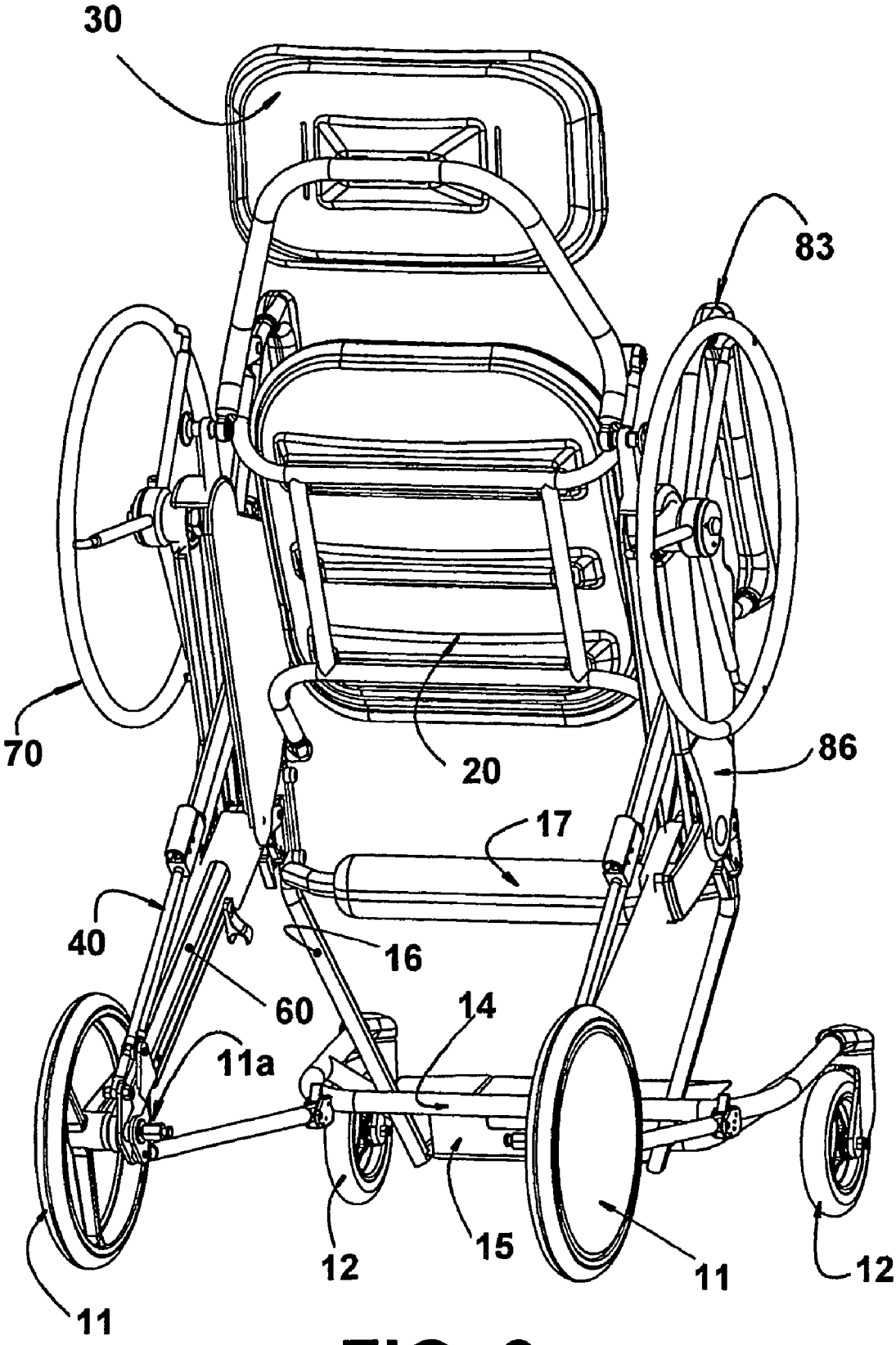
FIG. 9 is a schematic rear perspective view of the locomotion device of the present invention in the standing position.
Figure 10:
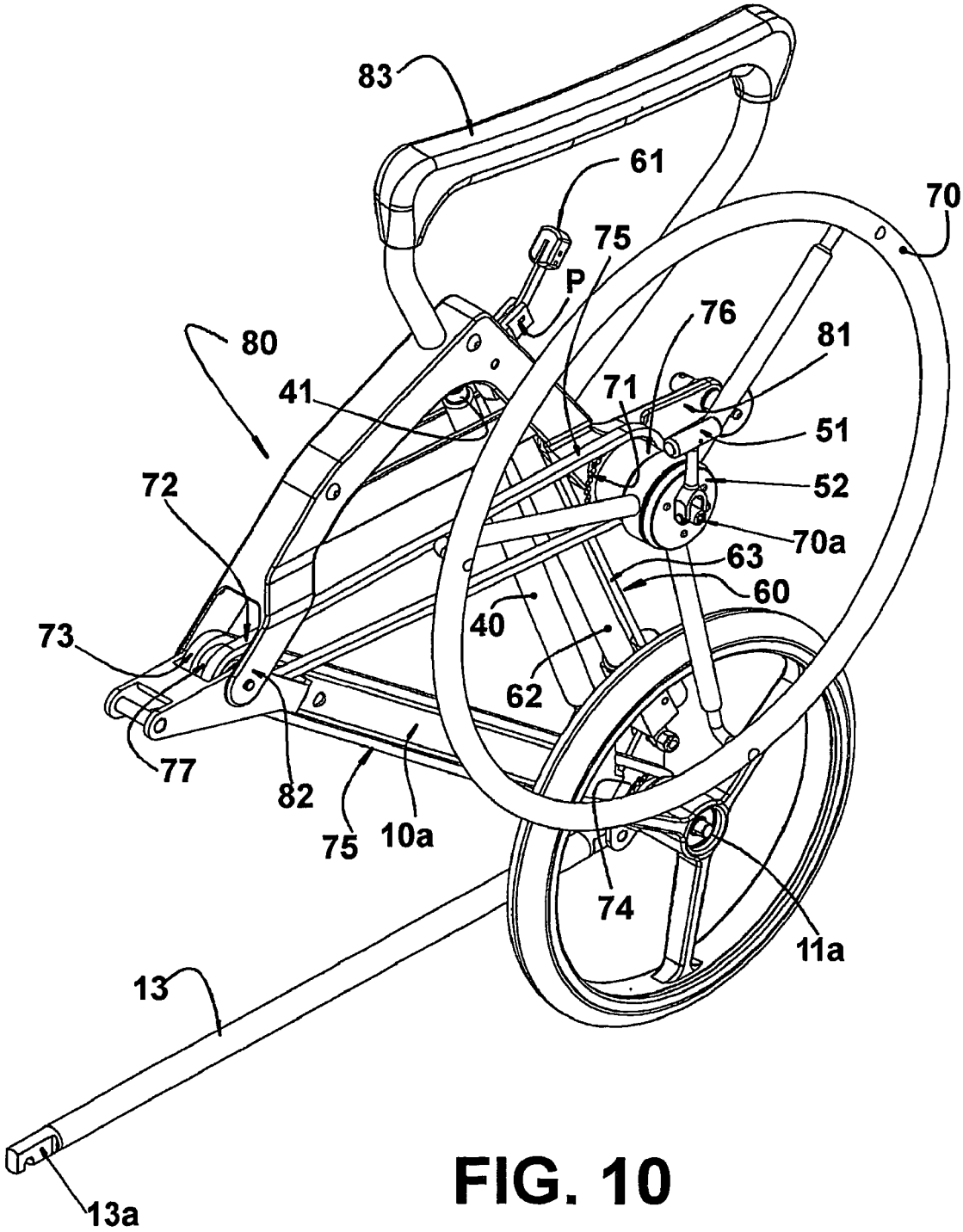
FIG. 10 is a schematic external perspective view of part of one side of the locomotion device of the present invention in the conventional sitting position.
Figure 11:
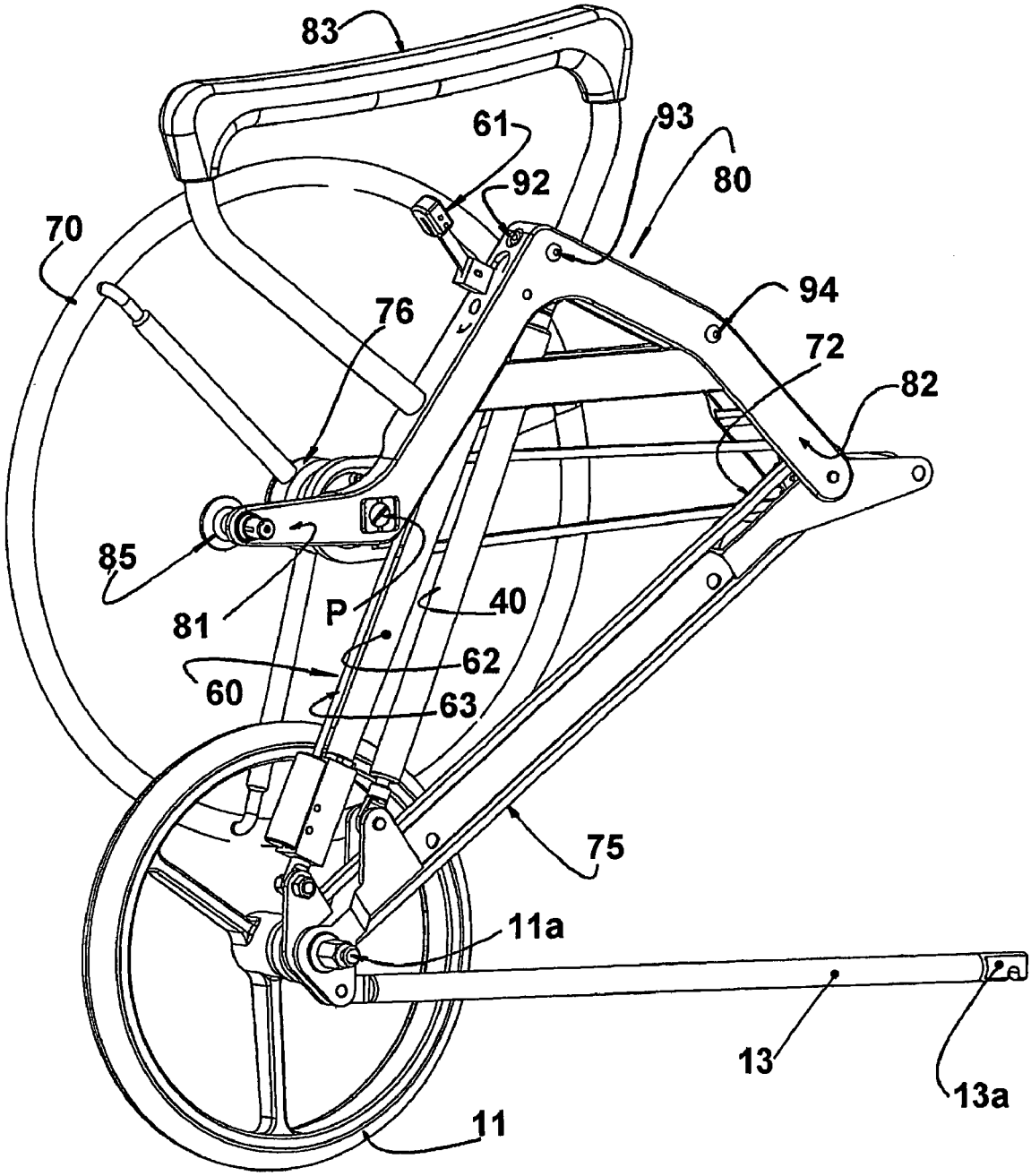
FIG. 11 is a schematic internal perspective view of part of one side of the locomotion device of the present invention in the conventional sitting position.
Figure 12:
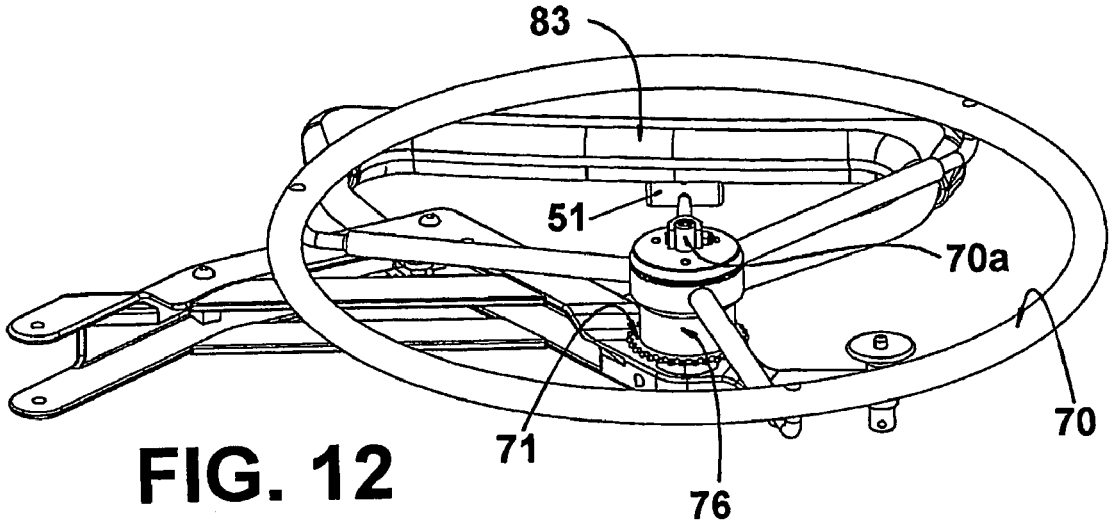
FIG. 12 is a schematic lower perspective view of part of one side of the locomotion device of the present invention.
Figure 13:
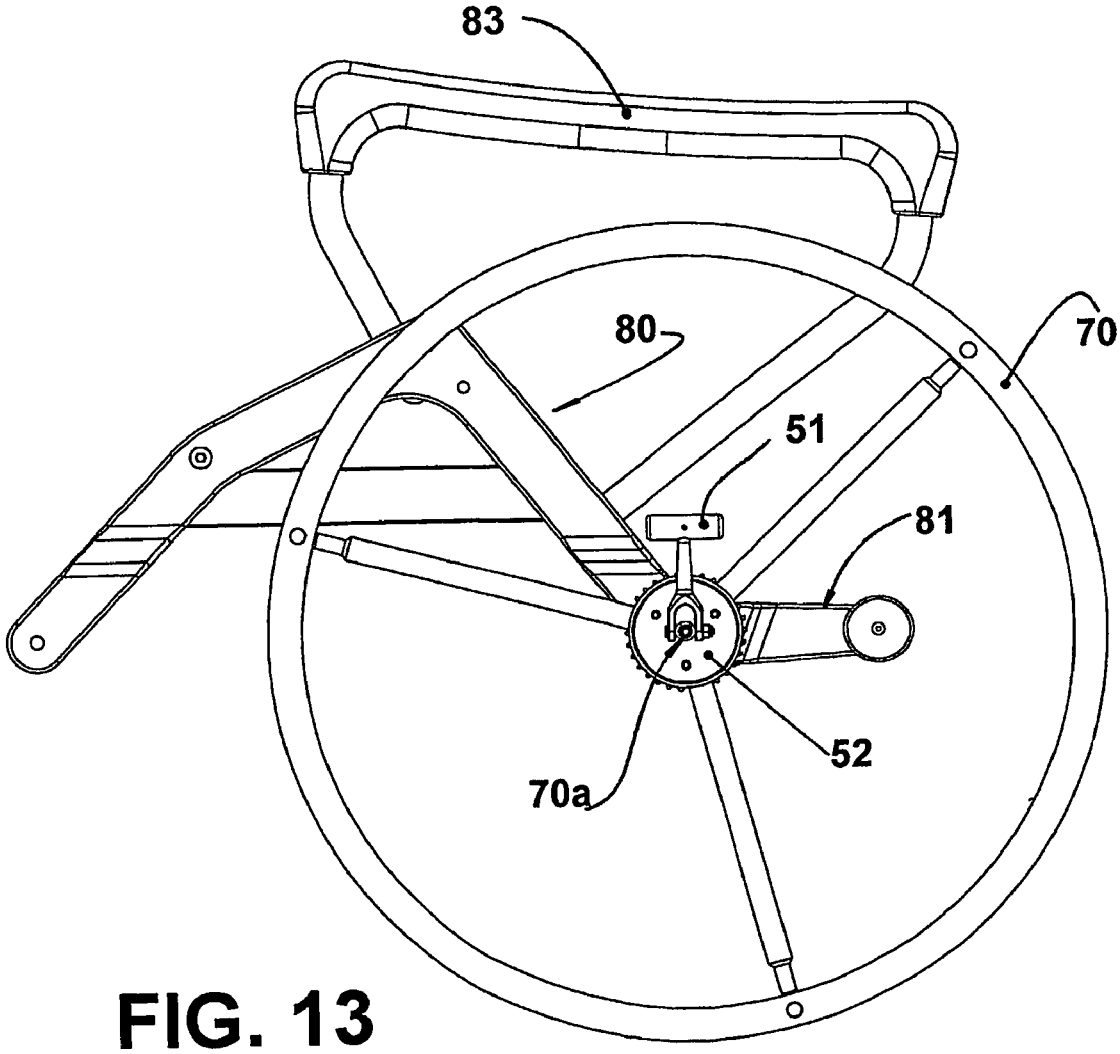
FIG. 13 is a schematic external view of part of one side of the locomotion device of the present invention illustrated in FIG. 10.

The front basic leg 14 is engaged to the lateral legs of the chassis 10 through a pair of couplings 14*a*, each receiving and securing a respective end 13*a* of a lateral leg of the chassis 10. The chassis 10 further presents a pair of upper legs 16, each having a lower end which is secured, for example, to a rear edge of the footrest 15 (FIG. 7) adjacent to an end edge of said footrest 15, and an upper end that is hinged to the seat frame 20 at the front hinge portion of the latter. The upper legs 16 carry, at an upper median portion, a calfrest 17, which is made of a foamed and coated material and provided in the chassis 10, inferiorly and forwardly displaced from a front portion of the seat frame 20.

Above the region where the calfrest 17 is provided, each upper leg 16, below the coupling articulated to the seat frame 20, there is provided a coupling 16*a*, which receives and affixes a front end of a respective rigid rod 10*a* of the chassis 10. The coupling between each upper leg 16 and the seat frame 20 is effected, for example, through a respective eye 20*a*, said eyes 20*a* being aligned to each other and to the articulation shaft of the seat frame 20.

The articulation between the seat frame 20 and the backrest 30 occurs through a pair of respective eyes 20*b*, each provided from a rear lateral portion of said seat frame 20, backwardly upwardly extending from the seat 21 and being arranged in an alignment superior to an alignment of respective eyes 30*a* of the backrest frame 30 of articulation to the rear end 81 of the raising structure 80 at a point backward of the mounting point of the respective steering wheel 70 to said raising structure 80.

These couplings allow the present device to be dismounted, for example, in three parts, the first part comprising a portion of the chassis 10 carrying the seat frame 20, the backrest frame 30, the footrest 15, the calfrest 17, and the pair of front wheels 12, and the second and third parts each defined by one of the sides of the device and comprising a respective rear wheel 11, a lateral leg 13 of the chassis 10, an impelling means 40, a movement locking means 50, a position locking means 60, a steering wheel 70, and a raising structure 80. In the dismounted position, said backrest frame 30 is collapsed against the seat of the seat frame 20 and said both frames are collapsed against the upper legs 16 and the calf rest 17, so that a rear edge of the seat is placed on the footrest 15.

For disassembling the present device, each of the sides thereof, which is formed by a respective rear wheel 11 and lateral leg 13 of the chassis 10, by the impelling means 40 and the steering wheel 70, is disengaged from said basic portion structure. To be disassembled, for example for transportation, the present device should be with the seat frame 20 in its first position and with both the movement locking means and the position locking means in an operative condition, subsequently unlocking the backrest 30. Such unlocking is achieved by pressing each engaging element 85, which acts on a respective eye 30*a* of the backrest 30. In the disassembly of the present device, the user pulls each engaging element 85, so as to separate them from the chassis 10, thus liberating the backrest 30.

In the illustrated construction, each raising structure has part of its extension provided internal to a panel 86 that covers the front end 82 of said raising structure 80, one of the chains 75 of the motor assembly, and the median portion of the raising structure 80.

With these movements, the user causes both seat frame 20 and backrest frame 30 to collapse, fastening the collapsed assembly thus obtained with the sub-patellar belt. The assembly of the present device can be effected in the inverse order of the dismounting operation described above.

The invention claimed is:

1. A locomotion device for physically disabled persons, characterized in that it comprises:

a chassis (10) mounted onto a pair of rear wheels (11) and a pair of front swiveling wheels (12), said chassis (10) carrying a motor assembly for the selective drive of the rear wheels (11);

a seat frame (20) frontally articulated to the chassis (10), so as to be displaced between a substantially horizontal first position and a second raised position that is markedly downwardly forwardly inclined;

a backrest frame (30), which is inferiorly articulated to a rear portion of the seat frame (20) and to the chassis (10), in order to be displaced between a first position, which is substantially orthogonal to the seat frame (20), and a second position, which is substantially coplanar to said seat frame (20), when the seat frame (20) is displaced between the first position and the second position, respectively;

an impelling means (40), which is operatively coupled to the chassis (10) and to at least one of the seat frame and backrest frame (20, 30), in order to provide the selective displacement of the seat frame (20) between its first position and its second position;

a movement locking means (50, 50'), which is mounted to the chassis (10) to allow the selective locking of the rear wheels (11);

a position locking means (60), which is mounted to the chassis (10) and operatively associated to the seat frame (20), in order to maintain the latter in any operational position between the first position and the second position, and a raising structure (80) carrying a respective armrest (83) and which is provided lateral and external to each adjacent seat frame (20) and has a rear end (81) articulated to the backrest frame (30) and a front end (82) articulated to the chassis (10) at a point backward of the articulation point of the seat frame (20) to the chassis (10), the impelling means (40) being operatively associated with the backrest frame (30) through the pair of raising structures (80).

2. The locomotion device as set forth in claim 1, characterized in that the motor assembly comprises, on each side of the chassis (10), a steering wheel (70) to be manually grasped, having a horizontal shaft journalled on a respective side of the seat frame (20) and operatively coupled to the shaft of a respective rear wheel (11) to transmit rotation to the latter in any operational position of the seat frame (20).

3. The locomotion device as set forth in claim 2, characterized in that the motor assembly comprises, on each side of the chassis (10), a first sprocket (71); a second sprocket (72) mounted to the chassis (10) in a coaxial position in relation to the hinge shaft of the seat frame (20); a third sprocket (73) that is coaxial to and carried by the second sprocket (72), and a fourth sprocket (74) secured to a respective rear wheel (11), said first and second and said third and fourth sprockets (71, 71, 73 and 74) being coupled to each other through respective chains (75).

4. The locomotion device as set forth in claim 3, characterized in that each steering wheel (70) is mounted to a respective raising structure (80) close to the rear end (81) of the latter.

5. The locomotion device as set forth in claim 3, characterized in that the impelling means (40) takes the form of a pneumatic actuator.

6. The locomotion device as set forth in claim 1, characterized in that the chassis (10) is "U" shaped, with each of the free ends of its lateral legs (13) bearing a shaft of a respective rear wheel (11), with a front basic leg (14) carrying the pair of front wheels (12) and being dismountably coupled to the front end (82) of the raising structure (80) and lateral legs (13) of the chassis (10), the rear end (81) of the raising structures (80) being dismountably coupled to the backrest frame (30), and with the backrest frame (30) and the seat frame (20) being collapsible in relation to each other and onto the front basic leg (14) of the chassis (10).

7. The locomotion device as set forth in claim 1, characterized in that the position locking means (60) comprises a pair of second levers (61), each provided in a respective raising structure (80) and actuating on a respective impelling means (40), and a pair of mechanical locks (62), each mounted to one side of the chassis (10) and having a lower end engaged to the rear end of the chassis (10) and an upper end actuating on the respective raising structure (80).

8. The locomotion device as set forth in claim 7, characterized in that the locking means (62) are telescopic locks, each being manually operated by a respective second lever (61) of the position locking means (60).

9. The locomotion device as set forth in claim 8, characterized in that it comprises, in each raising structure (80), a respective effort regulating means (90), which is operatively associated with a respective impelling means (40) to allow determining the region where said impelling means will apply force to the respective raising structure (80).

10. The locomotion device as set forth in claim 9, characterized in that each effort regulating means (90) comprises a threaded rod (91) that is rotatively mounted to the raising structure (80) and carries a slider (92) to which is articulated the upper end (41) of the impelling means (40), said slider (91) being displaced by the threaded rod (91) so as to adjust the force required for the user to raise and lower the seat frame (20).

11. The locomotion device as set forth in claim 1, characterized in that the chassis (10) carries a footrest (15) provided on the front basic leg (14) of the chassis (10), between the rear wheels (12) in a position in front of the seat frame (20).

12. The locomotion device as set forth in claim 1, characterized in that the chassis (10) carries a calf rest (17) between a pair of upper legs (16) of the chassis (10) extending from the footrest (15) and coupled to the seat frame (20).

13. The locomotion device as set forth in claim 3, characterized in that each raising structure (80) is provided with a panel (86) covering at least part of said raising structure (80).

14. The locomotion device as set forth in claim 1, characterized in that it includes at least one belt fastening the user to the backrest frame (30) and another belt fastening the user's legs to the chassis (10).

15. The locomotion device as set forth in claim 1, characterized in that it consists of three dismountable parts, the first part comprising a portion of the chassis (10) carrying the seat frame (20), the backrest frame (30), footrest (15), the calf rest (17), and the pair of front wheels (12), and the second and third parts, each defining one of the sides of the device and comprising a respective rear wheel (11), a lateral leg (13) of the chassis (10), an impelling means (40), a movement locking means (50), a position locking means (60), a steering wheel (70), and a raising structure (80).

16. The locomotion device as set forth in claim 15, characterized in that the three parts are mounted to each other through couplings.

* * * * *